US005575386A

United States Patent [19]

Focke et al.

[11] Patent Number: 5,575,386

[45] Date of Patent: Nov. 19, 1996

[54] HINGE-LID BOX, IN PARTICULAR FOR CIGARETTES

[75] Inventors: Heinze Focke, Verden; Hans-Jürgen Bretthauer, Bremen, both of Germany

[73] Assignee: Focke & Co. (GmbH & Co.), Verden, Germany

[21] Appl. No.: 384,575

[22] Filed: Feb. 6, 1995

[30] Foreign Application Priority Data

Feb. 9, 1994 [DE] Germany ..... 44 04 146.2

[51] Int. Cl.[6] ..... B65D 85/10

[52] U.S. Cl. ..... 206/264; 206/268; 229/243

[58] Field of Search ..... 206/264, 265, 206/268, 271, 273; 229/160.1, 243

[56] References Cited

U.S. PATENT DOCUMENTS

| | | | |
|---|---|---|---|
| 2,998,910 | 9/1961 | Gillam | 206/268 |
| 3,708,108 | 1/1973 | Rosenburg, Jr. | 206/268 |
| 4,732,276 | 3/1988 | Knecht | 206/268 |
| 5,161,733 | 11/1992 | Latif | 206/268 |
| 5,358,105 | 10/1994 | Boriani et al. | 206/273 |

FOREIGN PATENT DOCUMENTS

| | | | |
|---|---|---|---|
| 2293368 | 7/1976 | France . | |
| 2551427 | 5/1977 | Germany | 206/268 |
| 3234411 | 5/1983 | Germany . | |
| 3713612 | 11/1988 | Germany . | |
| 9114927 | 5/1992 | Germany . | |
| 518117 | 6/1976 | U.S.S.R. . | |
| 1223836 | 4/1986 | U.S.S.R. . | |
| 2171081 | 8/1986 | United Kingdom . | |

*Primary Examiner*—Jimmy G. Foster
*Attorney, Agent, or Firm*—Abelman, Frayne & Schwab

[57] ABSTRACT

Hinge-lid boxes comprise box part and lid. In order, in the case of this type of pack, to ensure an exact closed position of the lid before use, connecting webs or material webs are formed between lid and box part, said webs being severed when the lid is opened. Preferably, the material webs are located exclusively in the region of inner side tabs and lid side tabs, for connection of the same in the region of an obliquely directed abutment edge and mating edge.

5 Claims, 3 Drawing Sheets

HINGE-LID BOX, IN PARTICULAR FOR CIGARETTES

DESCRIPTION

Figure 1:
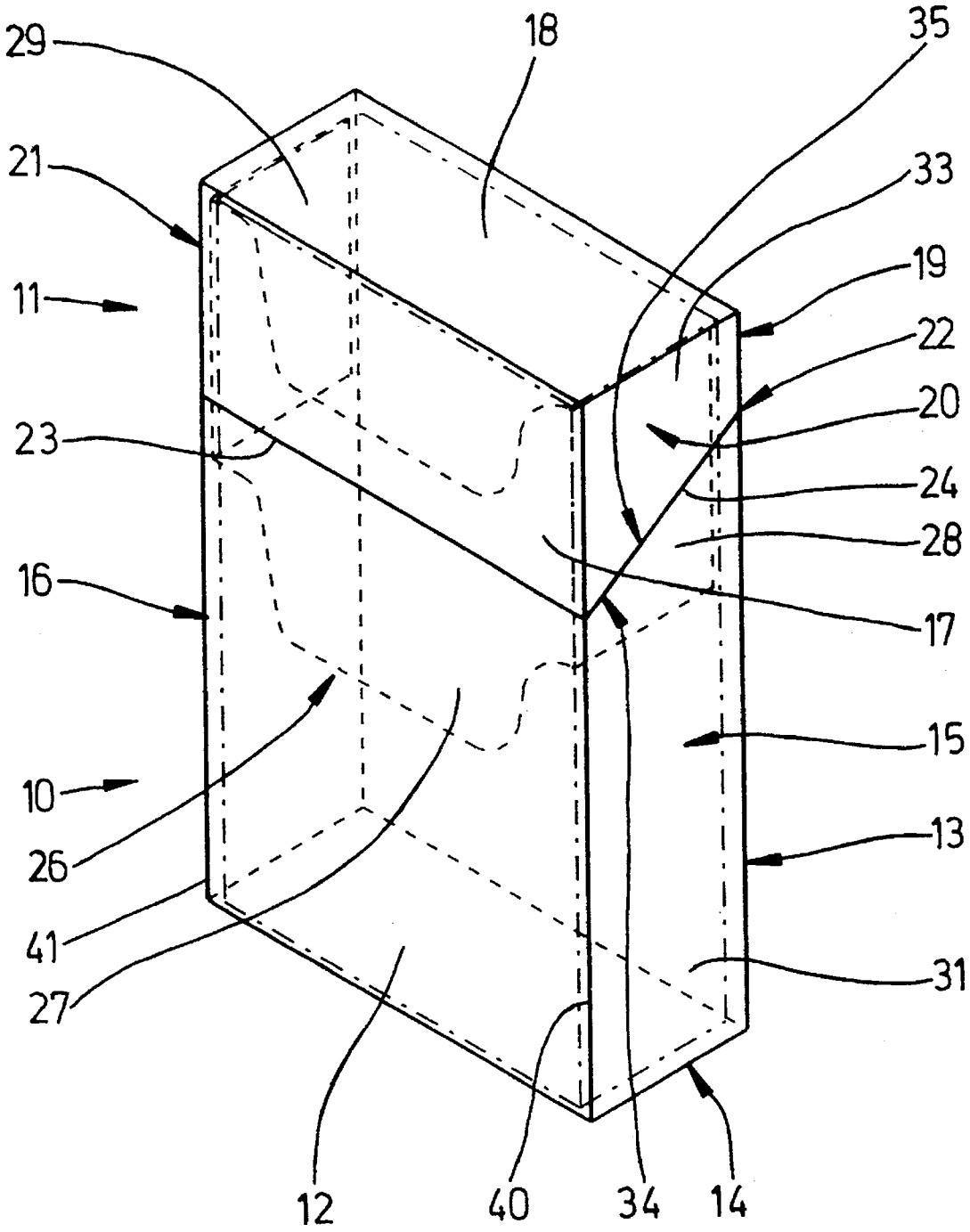

The invention relates to a hinge-lid box for cigarettes or the like, comprising a box part and a lid which is connected to said box part.

The use of hinge-lid boxes—also called hinge-lid packs—as packs for cigarettes is widespread throughout the world. The standard construction of a hinge-lid box is such that the pack contents, namely a cigarette group, are enclosed by an inner blank of paper or tin foil. The hinge-lid box itself consists of thin cardboard. A collar with collar front wall and collar side tabs is located within the box part. The collar projects, by means of an upper sub-region, out of the box part and is surrounded by the lid in the closed position.

Box part and lid are connected to one another in the region of the rear wall and lid rear wall via an articulating line. In the region of the front wall and lid front wall, box part and lid form a transversely directed joint. An obliquely directed joint is located in the region of the side walls and lid side walls.

Up until now, the hinge-lid box designed in this manner has conventionally been enclosed by an outer wrapping of thin plastic film.

Recently, hinge-lid boxes without an outer film wrapping have been available. The danger with these is that the lid does not remain in the closed position before use of the pack. Especially upon removal of such packs from vending machines, there is the danger of the lid being moved into the open position.

The object of the invention is to propose measures which ensure exact fixing of the lid before use, even in the case of hinge-lid boxes which do not have an outer film wrapping, without the handling and the outer appearance of a typical hinge-lid box being impaired as a result.

In order to achieve this object, the pack according to the invention is characterized in that the side walls of the box part, on the one hand, and the lid side walls, on the other hand, are connected directly to one another by connecting webs made of a material of the hinge-lid box, it being possible for the connecting webs to be severed when the lid is opened for the first time.

A particularly advantageous configuration of the pack according to the invention consists in the fact that, up until use, box part and lid are connected to one another exclusively by in each case two connecting webs in the region of inner side tabs of the box part, on the one hand, and inner lid side tabs, on the other hand, in each case one connecting web being fitted in the region of an upright front edge of the pack, and the other connecting web being fitted in each case at a distance therefrom, preferably in the centre of the inner side tabs and lid side tabs.

By virtue of this configuration of the hinge-lid box and the arrangement of the connecting webs, a statically optimum closure force is exerted on the lid. Upon use, however, the lid can be moved into the open position without difficulty, the connecting webs being severed in the process.

Figure 2:
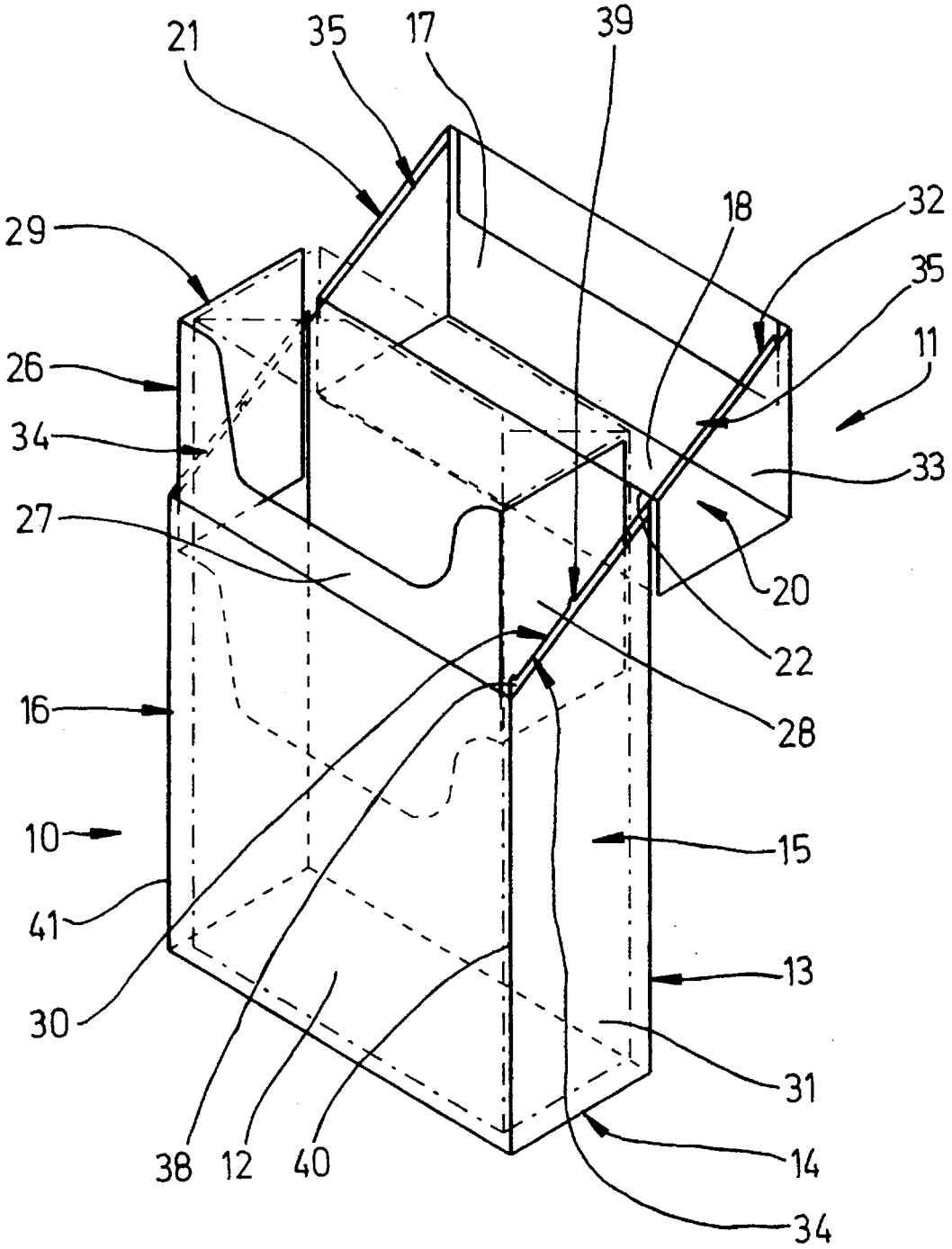
Figure 3:
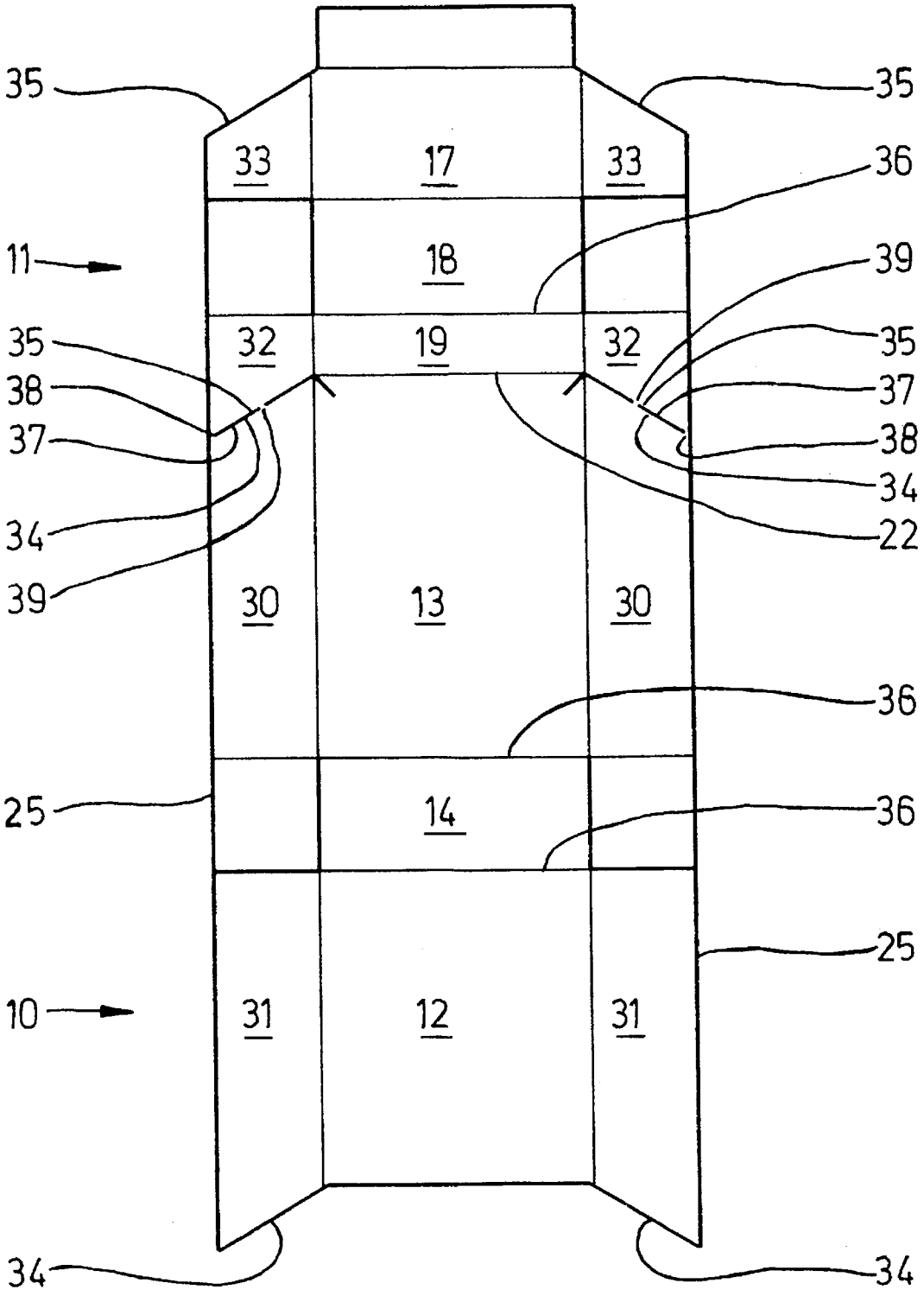

Further details and features of the hinge-lid box according to the invention are explained in more detail hereinbelow with reference to the drawings, in which:

FIG. 1 shows a perspective representation of a hinge-lid box in the closed position, FIG. 2 shows the hinge-lid box according to FIG. 1 in the open position, and FIG. 3 shows a blank, in the spread-out state, for the production of a hinge-lid box according to FIGS. 1 and 2.

The hinge-lid box shown as an exemplary embodiment is designed predominantly in the conventional manner. A lower box part 10 and a lid 11 are connected pivotably to one another. The box part 10 comprises front wall 12, rear wall 13, base wall 14 and narrow, upright side walls 15, 16. Correspondingly, the lid 11 comprises lid front wall 17, lid upper wall 18, lid rear wall 19 and lid side walls 20 and 21.

Box part 10 and lid 11 are connected to one another in the region of the rear wall 13 and lid rear wall 19 via a transversely directed hinge line 22.

In the closed position, there is a transversely directed joint 23 between front wall 12 and lid front wall 17. Oblique joints 24 rising towards the rear side of the hinge-lid box are formed between the side walls 15, 16, on the one hand, and the lid side walls 20, 21, on the other hand.

A collar 26 is fixed in the box part 10. Said collar comprises collar front wall 27 and collar side tabs 28, 29. A region of the collar 26 which projects out of the box part 10 is surrounded by the lid 11 in the closed position.

In the case of this type of pack, side walls 15, 16 and lid side walls 20, 21 are of a double-layered design, that is to say they comprise inner and outer side tabs 30 and 31 and lid side tabs 32 and 33 which are located one above the other. The abovementioned side tabs 30, 31 and 32, 33 are connected to one another by adhesive bonding in order to form the side walls 15, 16 and 20, 21, respectively. The side tabs 30, 31 and lid side tabs 32, 33 jointly form obliquely directed abutment edges 34 of the box part 10 and mating edges 35 of the lid 11.

The blank (FIG. 3) is such that, in a central region, areas for front wall 12, rear wall 13, base wall 14, etc. are defined one after the other by folding lines 36. The side tabs 30, 31 and lid side tabs 32, 33 are arranged on the side. An obliquely running punch cut 37 is formed between the inner side tabs 30, on the one hand, and the inner lid side tabs 32, on the other hand. Said punch cut separates the abovementioned side tabs 30, 32 from one another and, at the same time, forms the inner layer of the abutment edge 34 and mating edge 35.

The special feature consists in the fact that, before use of the hinge-lid box, that is to say before the lid 11 has been opened for the first time, box part 10 and lid 11 are connected to one another by material webs or connecting webs 38, 39 which are severed when the lid 11 is opened. In the case of the present exemplary embodiment, said connecting webs 38, 39 are arranged exclusively in the region of the side walls 15, 16 and lid side walls 20, 21, to be precise in the region of the inner side tabs 30 and lid side tabs 32. The latter are connected to one another in the region of mutually facing edges, namely in the region of the abutment edge 35 and mating edge 35.

In the case of the present exemplary embodiment, two connecting webs 38, 39 are provided in each case. One connecting web 38 is located at the outermost free border 25 of the blank or of the side tabs 30 and lid side tabs 32. With the hinge-lid box in the finished state, said connecting web 38 extends in the region of upright front edges 40, 41. A further connecting web 39 is arranged, in the present case, at a distance from the border-side connecting web 38, to be precise approximately in the centre of the side tabs 30 and lid side tabs 32.

With the hinge-lid box in the finished state, the connecting webs 38, 39 are located, as a result of the positioning of the side tabs 30 and lid side tabs 32, in an inner region of the hinge-lid box, and can thus barely be seen from the outside. Upon opening the lid 11 by gripping the front wall 12, the connecting webs 38, 39 are severed (FIG. 2).

The production of the blank according to FIG. 3 is just as unproblematic as the manufacture of the hinge-lid box itself. During punching of the blanks, use is simply made of slightly modified punching tools in the region of the punch cut 37, that is to say such that the connecting webs 38, 39 remain intact.

The connecting webs 38, 39 according to the invention are also a sure way of checking against un-authorized opening of the hinge-lid box before use.

We claim:

1. Hinge-lid box for cigarettes, comprising a box part (10) and a lid (11) which is connected pivotably to said box part (10), characterized by the following features:

a) the box part (10) comprises a front wall (12), a rear wall (13), a base wall (14) and two side walls (15, 16), b) the side walls (15, 16) each comprise two mutually overlapping side tabs (30, 31), said side tabs (30, 31) comprising inner side tabs (30) and outer side tabs (31), each one of said outer side tabs (31) covering one of said inner side tabs (30), each one of said inner side tabs (30) being connected to one of said outer side tabs (31), c) the lid (11) comprises a lid front wall (17), a lid rear wall (19), a lid upper wall (18) and two lid side walls (20, 21), oblique joints (24) being formed between the side walls (15, 16) and the lid side walls (20, 21), d) the lid side walls (20, 21) each comprise two mutually overlapping lid side tabs (32, 33), said lid side tabs (32, 33) comprising inner lid side tabs (32) and outer lid side tabs (33), each one of said outer lid side tabs (33) covering one of said inner lid side tabs (32), each one of said inner lid side tabs (32) being connected to one of said outer lid side tabs (33), e) free edges of the box part (10), on the one hand, and of the lid (11), on the other hand, butt against one another, at the top of the front wall (12) of the box part (10) and at the top of the side walls (15, 16) of the box part (10), in the closed position of said lid (11), f) the side walls (15, 16) of the box part (10), on the one hand, and the lid side walls (20, 21), on the other hand, are connected directly to one another by connecting webs (38, 39) which can be severed when the lid (11) is opened for the first time, and g) the connecting webs (38, 39) exclusively connect said inner side tabs (30) to said inner lid side tabs (32) across the oblique joints (24), whereby the connecting webs (38, 39) are barely visible from the outside of the hinge-lid box when the lid (11) is in the closed position.

2. Hinge-lid box according to claim 1, characterized in that each of a first pair (38) of the connecting webs (38, 39) is located approximately at the top of one of the upright front edges (40, 41) formed by the junction Of the front wall (12) and the side walls (15, 16) and each of a second pair (39) of the connecting webs (38, 39) is arranged approximately in the center of the dimension of each of the inner side tabs (30) spanning the distance between the front wall (12) and the rear wall (13) and approximately in the center of the dimension of each of the inner lid side tabs (32) spanning the distance between the lid front wall (17) and the lid rear wall (19).

3. Hinge-lid box according to claim 1, characterized in that each of a pair (38) of the connecting webs (38, 39) is located approximately at the top of one of the upright front edges (40, 41) formed by the junction of the front wall (12) and the side walls (15, 16).

4. Hinge-lid box according to claim 1, characterized in that each of a pair (39) of the connecting webs (38, 39) is arranged approximately in the center of the dimension of each of the inner side tabs (30) spanning the distance between the front wall (12) and the rear wall (13) and approximately in the center of the dimension of each of the inner lid side tabs (32) spanning the distance between the lid front wall (17) and the lid rear wall (18).

5. Hinge-lid box for cigarettes, comprising a box part (10) and a lid (11) which is connected pivotably to said box part (10), characterized by the following features:

a) the box part (10) comprises a front wall (12), a rear wall (13), a base wall (14) and two side walls (15, 16), b) the side walls (15, 16) each comprise two mutually overlapping side tabs (30, 31), said side tabs (30, 31) comprising inner side tabs (30) and outer side tabs (31), each one of said outer side tabs (31) covering one of said inner side tabs (30), each one of said inner side tabs (30) being connected to one of said outer side tabs (31), c) the lid (11) comprises a lid front wall (17), a lid rear wall (19), a lid upper wall (18) and two lid side walls (20, 21), oblique joints (24) being formed between the side walls (15, 16) and the lid side walls (20, 21), d) the lid side walls (20, 21) each comprise two mutually overlapping lid side tabs (32, 33), said lid side tabs (32, 33) comprising inner lid side tabs (32) and outer lid side tabs (33), each one of said outer lid side tabs (33) covering one of said inner lid side tabs (32), each one of said inner lid side tabs (32) being connected to one of said outer lid side tabs (33), e) free edges of the box part (10), on the one hand, and of the lid (11), on the other hand, butt against one another, at the top of the front wall (12) of the box part (10) and at the top of the side walls (15, 16) of the box part (10), in the closed position of said lid (11), f) the side walls (15, 16) of the box part (10), on the one hand, and the lid side walls (20, 21), on the other hand, are connected directly to one another by connecting webs (38, 39) which can be severed when the lid (11) is opened for the first time, g) the connecting webs (38, 39) exclusively connect said inner side tabs (30) to said inner lid side tabs (32) across the oblique joints (24), whereby the connecting webs (38, 39) are barely visible from the outside of the hinge-lid box when the lid (11) is in the closed position, and h) each of a pair (38) of the connecting webs (38, 39) is located approximately at the top of one of the upright front edges (40, 41) formed by the junction of the front wall (12) and the side walls (15, 16).

* * * * *